US011094231B2

(12) United States Patent
Ruszczyc et al.

(10) Patent No.: US 11,094,231 B2
(45) Date of Patent: Aug. 17, 2021

(54) METAL POSTER WITH RELIEF PRINTED FRAME

(71) Applicant: GWD Concept Sp. z o.o, Warsaw (PL)

(72) Inventors: Edward Lech Ruszczyc, Warsaw (PL); Piotr Kulaga, Warsaw (PL)

(73) Assignee: GWD CONCEPT SP ZO.O

( * ) Notice: Subject to any disclaimer, the term of this patent is extended or adjusted under 35 U.S.C. 154(b) by 0 days.

(21) Appl. No.: 16/592,426

(22) Filed: Oct. 3, 2019

(65) Prior Publication Data

US 2020/0111393 A1 Apr. 9, 2020

Related U.S. Application Data

(60) Provisional application No. 62/742,848, filed on Oct. 8, 2018.

(51) Int. Cl.

| | |
|---|---|
| ***G09F 15/02*** | (2006.01) |
| ***B21D 28/26*** | (2006.01) |
| ***G09F 15/00*** | (2006.01) |

(52) U.S. Cl.

CPC ..... *G09F 15/02* (2013.01); *B21D 28/26* (2013.01); *G09F 15/0012* (2013.01)

(58) Field of Classification Search

CPC ..... B21D 28/26

See application file for complete search history.

(56) References Cited

U.S. PATENT DOCUMENTS

| | | | | |
|---|---|---|---|---|
| 2,209,957 | A * | 8/1940 | Chase | G09F 15/0012 40/624 |
| 2,621,431 | A * | 12/1952 | Rericker | G09F 7/00 40/612 |
| 5,600,412 | A | 2/1997 | Connors | |
| 5,720,123 | A | 2/1998 | Taylor | |
| 7,092,564 | B2 | 8/2006 | Jia | |
| 7,283,277 | B2 | 10/2007 | Li | |
| 7,589,868 | B2 | 9/2009 | Velde | |
| 8,863,420 | B2 * | 10/2014 | Edmondson | A47G 1/06 40/743 |
| 9,457,557 | B2 | 10/2016 | Koerkamp | |
| 10,232,649 | B2 | 3/2019 | Valade | |
| 2005/0270310 | A1 | 12/2005 | Jeffrey | |
| 2006/0172120 | A1 | 8/2006 | Longobardi | |
| 2010/0071240 | A1 * | 3/2010 | Fiegen | G09F 7/002 40/584 |
| 2013/0196124 | A1 * | 8/2013 | Flores | C09D 11/30 428/196 |
| 2019/0084326 | A1 * | 3/2019 | Deljou | A47G 1/06 |

FOREIGN PATENT DOCUMENTS

| | | | |
|---|---|---|---|
| EP | 3043546 | A1 | 7/2016 |
| WO | 2006029531 | A2 | 3/2006 |

* cited by examiner

*Primary Examiner* — Kristina N Junge
(74) *Attorney, Agent, or Firm* — Seth Natter; Natter & Natter

(57) ABSTRACT

A metal poster is formed with an integral frame which is relief printed on the obverse face of a sheet metal plate with layers of UV curable inks. Image indicia imprinted on the plate is surrounded by the relief printed frame. The ink layers extend into selvage areas of the plate. The selvage areas are folded over to the rear face of the sheet metal plate to provide the frame with relief printed rounded peripheral edges.

18 Claims, 6 Drawing Sheets

METAL POSTER WITH RELIEF PRINTED FRAME

RELATED APPLICATIONS

This application claims the benefit of Provisional Application No. 62/742,848 filed Oct. 8, 2018, the entirety of which is incorporated herein by reference.

BACKGROUND OF THE INVENTION

1. Field of the Invention

This invention relates generally to metal posters having indicia printed thereon and more particularly to metal posters having frames.

2. Antecedents of the Invention

Metal posters having edge-to-edge artwork or other image indicia printed thereon have been produced with preselected image indicia as well as with custom indicia, such as personal digital images, custom graphics, etc. In some instances, a heat fused sublimation dye printing technique has been employed; in other instances, UV curable inks have been employed. While advanced printing techniques have generated metal posters with enhanced image quality as opposed to paper or paperboard posters, borderless printed images on metal posters lacked the overall perception of a high quality framed image. While the employment of picture frames enhanced the overall appearance of metal posters, they increased the cost and in some instances interfered with poster wall mounting systems or presented assembly challenges.

SUMMARY OF THE INVENTION

Pursuant to the invention, an integral frame is relief printed on the front face of a sheet metal poster with UV curable inks to provide the three dimensional illusion that the imprinted image indicia is surrounded by a separate border frame. To enhance the three dimensional effect of the relief printed frame, the frame printing extends into selvage zones, beyond fold lines which define the boundary of the border frame which will appear on the obverse face of the poster. The selvage zones are then bent along the fold lines to overly the rear face of the poster, leaving the frame with visible relief printed rounded peripheral edges.

From the foregoing compendium, it will be appreciated that an aspect of the present invention is to provide a framed metal poster of the general character described which is not subject to the aforementioned disadvantages of the antecedents of the invention.

A feature of the present invention is to provide a framed metal poster of the general character described wherein the frame is relief printed on the metal poster.

A consideration of the present invention is to provide a unitary framed metal poster of the general character described wherein the frame is relief printed around the borders of image indicia.

To provide a framed metal poster of the general character described which is well suited for economical computerized printing techniques is another feature of the present invention.

A further aspect of the present invention is to provide a framed metal poster of the general character described which provides the illusion that imprinted image indicia is surrounded by a separate three dimensional border frame.

Another feature of the present invention is to provide a metal poster of the general character described wherein an integral frame is relief printed on the front face of a sheet metal poster with UV curable inks.

Another consideration of the present invention is to provide a framed metal poster of the general character described wherein portions of a relief printed frame are bent to overly the rear face of the poster, leaving the poster with a thick rounded relief printed peripheral edge.

To provide a framed metal poster of the general character described wherein both image indicia and a border frame are simultaneously ink jet printed with UV curable inks is yet a further aspect of the present invention.

Other aspects, features and considerations in part will be obvious and in part will be pointed out hereinafter.

With these ends in view, the invention finds embodiment in various combinations of elements, arrangements of parts and series of steps by which the above-mentioned aspects, features and considerations and certain other aspects, features and considerations are attained, or with reference to the accompanying drawings and the scope of which will be more particularly pointed out and indicated in the appended claims.

BRIEF DESCRIPTION OF THE DRAWINGS

In the accompanying drawings, wherein one of the various possible exemplary embodiments of the invention is shown.

DESCRIPTION OF THE INVENTION

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements.

Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein.

Applicants do not intend for any term in the specification or claims to be ascribed an uncommon or special meaning unless explicitly set forth as such. Further, the present invention encompasses present and future known equivalents to the known components referred to herein by way of illustration.

Figure 1:
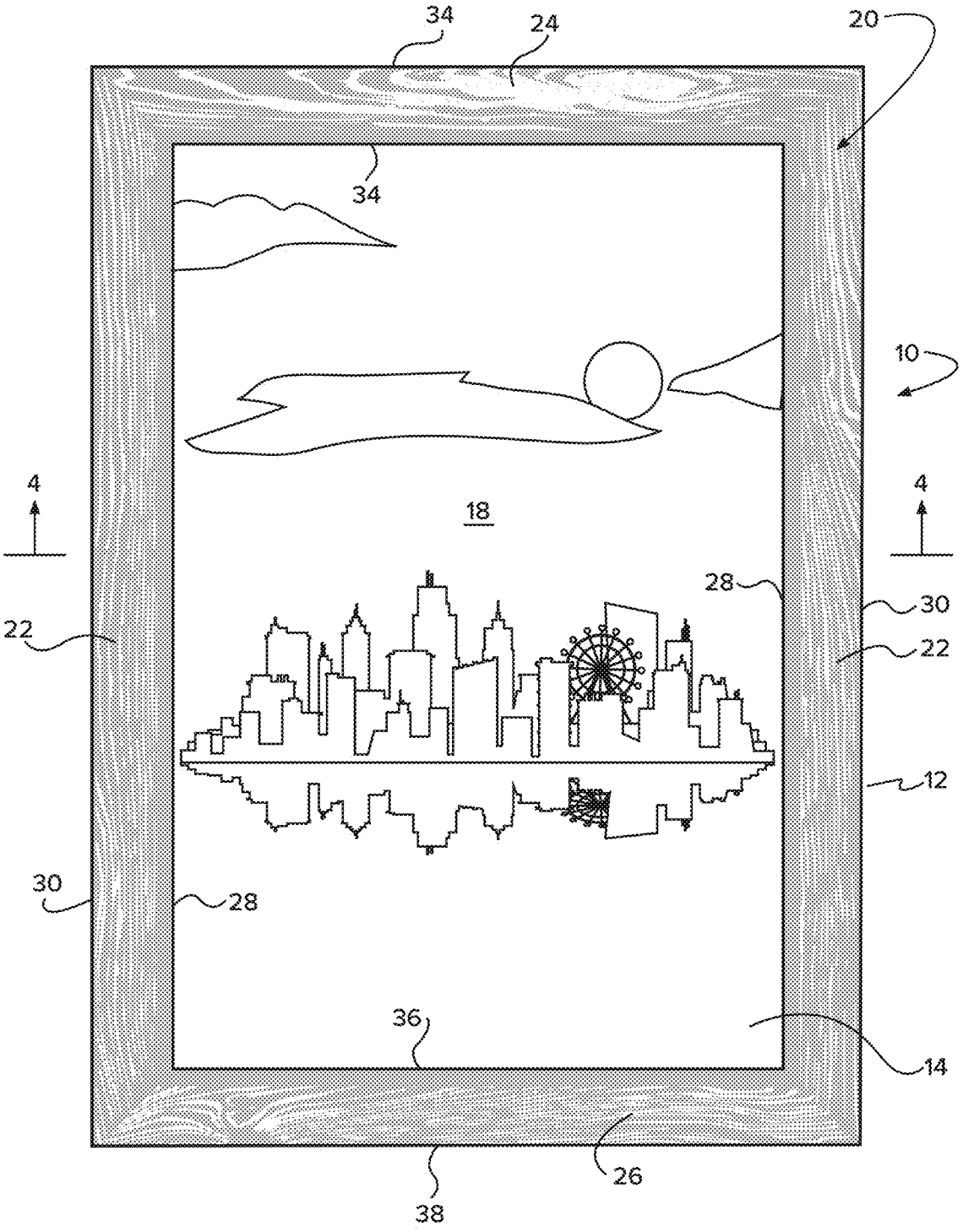
FIG. 1 is a plan view of a framed metal poster constructed in accordance with and embodying the invention and showing printed indicia comprising artwork surrounded by a relief printed frame.

Referring now to the drawings, the reference numeral 10 denotes generally a framed metal poster constructed in accordance with and embodying the invention. The poster 10 is imprinted on a sheet metal plate 12, depicted in FIG. 1. The poster 10 comprises a front or obverse face 14 and a rear face 16. Image indicia 18, such as, artwork, digital photographs, graphics, etc. are imprinted with UV curable inks on the obverse face 14.

Pursuant to the invention a relief printed frame 20 borders and defines the periphery of the image indicia 18. The frame 20 comprises a pair of parallel stiles 22, a header 24 and footer 26. Each stile 22 is defined by an inner edge 28, which separates the style 22 and the image indicia 18 and a rounded outer edge 30. The header 24 is defined by an inner edge 32 and a rounded outer edge 34, while the footer is defined by an inner edge 36 and a rounded outer edge 38.

Figure 2:
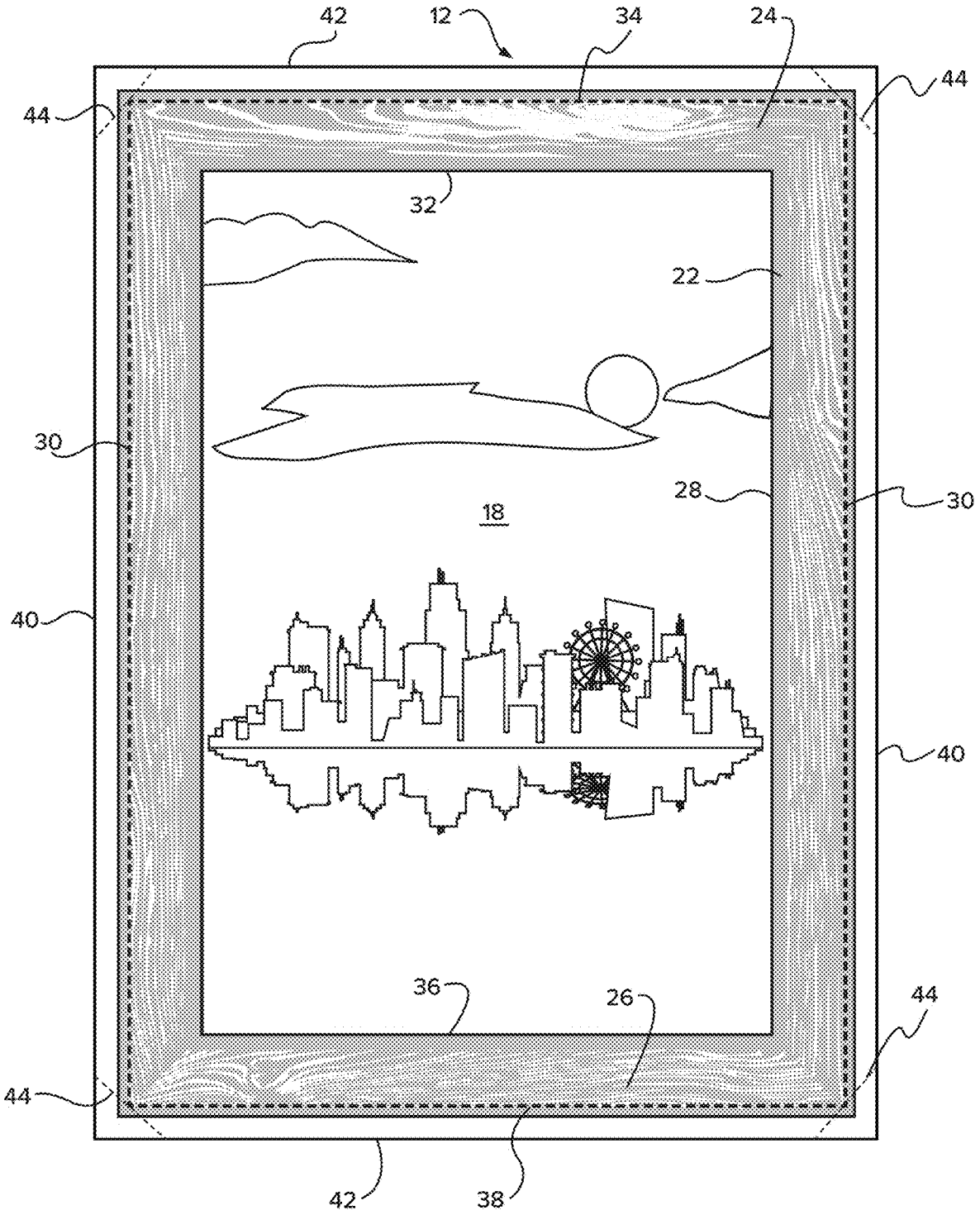
FIG. 2 is a plan view of the metal poster during production, after completion of a printing stage on a planar metal sheet metal plate and showing portions of a relief printed frame extending over the front face of the metal plate into a selvage zone.

With reference to FIG. 2, wherein the sheet metal plate 12 is depicted after the image indicia 18 and the frame 20 have been simultaneously printed, it should be noted that the sheet metal plate 12 includes parallel longitudinal peripheral edges 40 and parallel transverse peripheral edges 42. The rounded outer edges 30 of the stiles 22, the rounded outer edge 34 of the header 24 and the rounded outer edge 38 of the footer 26 have been depicted as dashed fold lines for illustration only and are not physically imprinted as part of the frame 20. As illustrated in FIG. 2, the relief printing of the frame 20 extends distally beyond the fold lines. The zones between the fold lines 30, 34 and 38 and the peripheral edges 40, 42 of the plate 12 comprise a selvage, a portion of which may be unprinted.

Figure 3:
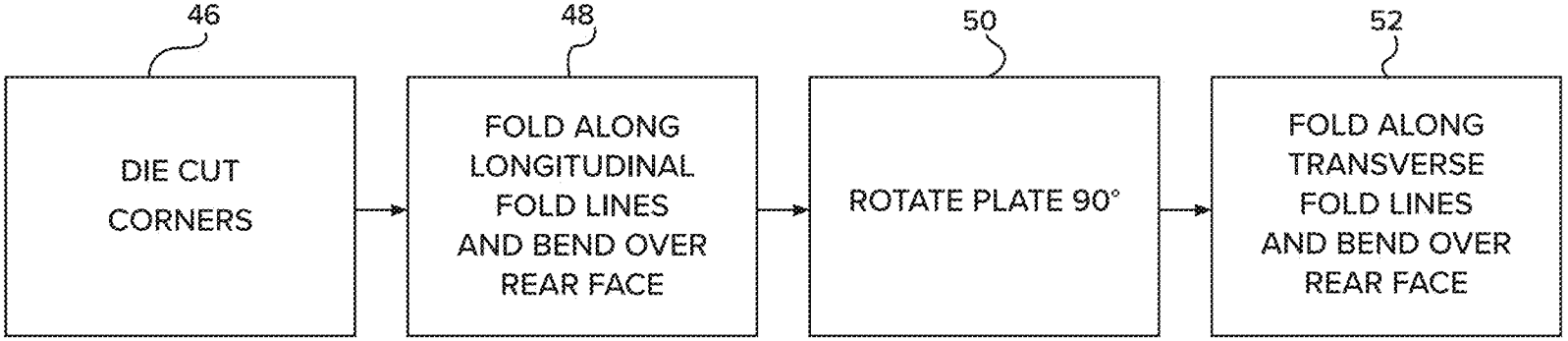
FIG. 3 is a schematized depiction of a sequence of finishing steps along a production line wherein corners of the metal plate are trimmed and the selvage zone is folded over to the rear face of the plate along fold lines.
Figure 4:
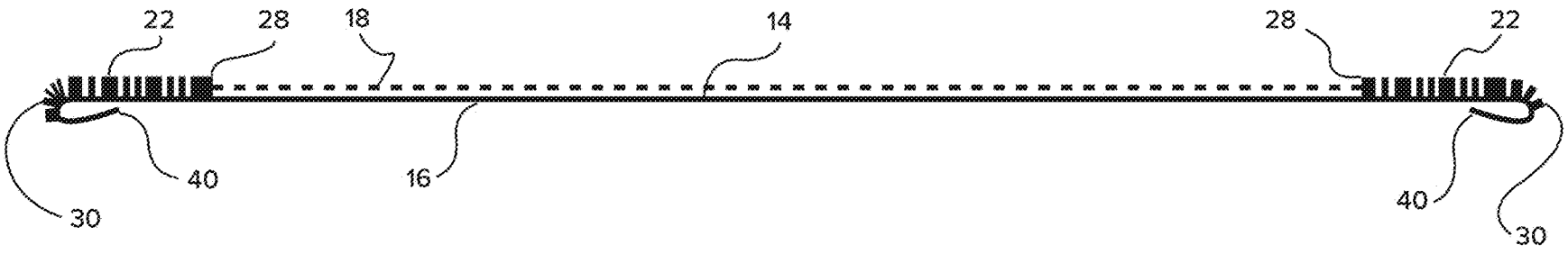
FIG. 4 is a fragmentary enlarged transverse sectional view taken substantially along the plane 4-4 of FIG. 1.

To fabricate the complete poster 10, the corners of the plate 12 are trimmed off at a 45° angle along the cut lines 44 as depicted in a box 46 of FIG. 3, leaving triangular scraps. Thereafter, the plate 12 moves to a folding station 48, wherein the selvage is folded about the longitudinal fold lines to overlie the rear face 16, leaving relief printed rounded outer edges 30 along the sides of the frame 20. The plate 12 is then moved to a further station wherein it is rotated 90°, as indicated in a box 50. The fabrication process is completed at a folding station 52, wherein the selvage is folded over the transverse fold lines to overlie the rear face 16, leaving relief printed top and bottom rounded outer edges 34, 38. It should be noted that the steps 48 and 52 can be performed in reverse order.

The three dimensional characteristics of the frame 22 is perceptible by both visual and tactile senses is generated by relief printing with UV curable inks in layers to provide surfaces which project from the obverse face 14 from 0.0 mm to 0.32 mm. Typical relief printing equipment for imprinting the frame 22 may comprise Hapt Print technology printers, available from Durst Phototechnik Digital Technology GmbH of Lienz, Austria.

The CMYK (cyan magenta, yellow and key (black)) subtractive color model is employed with the file having an additional channel for spot color representing white. The thickness of the white layer is proportional to saturation of the white color. The higher the saturation, the thicker each white layer. Several white layers can be printed on top of one another for increased three dimensional effect.

Figure 5:
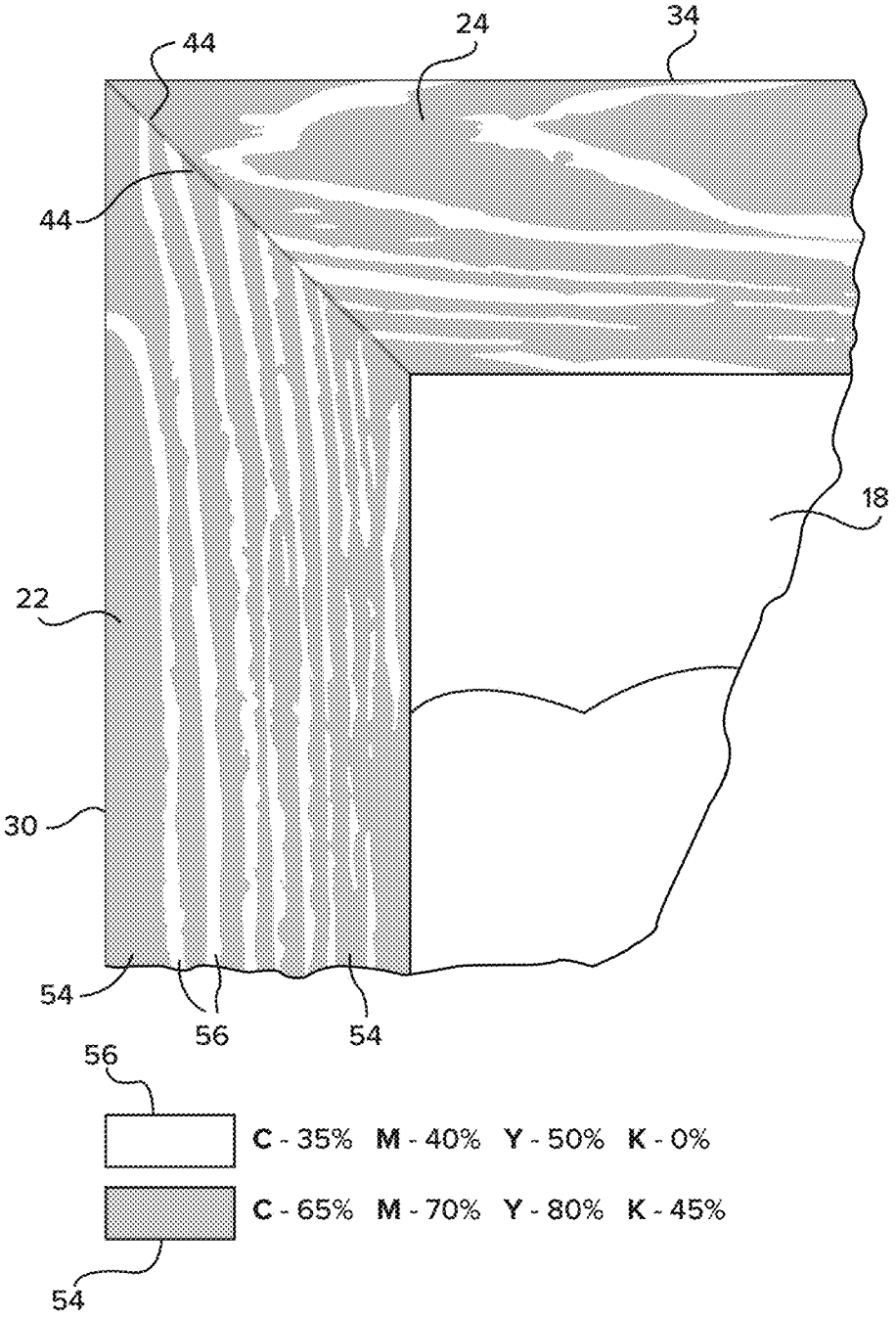
FIG. 5 is an enlarged fragmentary view of the upper left corner of the poster depicted in FIG. 1 and illustrating elements of the CMYK composition of the relief printed inks for simulation of a dark wood grain frame.

With reference now to FIG. 5, wherein a wood grain relief printed pattern has been relief imprinted on a frame 20, it will be seen that the pattern comprises wavy colored areas of dark brown ink 54 and wavy colored areas of light brown ink 56. The CMYK color model for the ink 56 could be, for example C 35%, M 49%, Y 50% and K 0%, while C 65% M 70% Y 80% and K 45% may be employed for the ink 54. The color models are exemplary only and need not be shades of brown.

Figure 6:
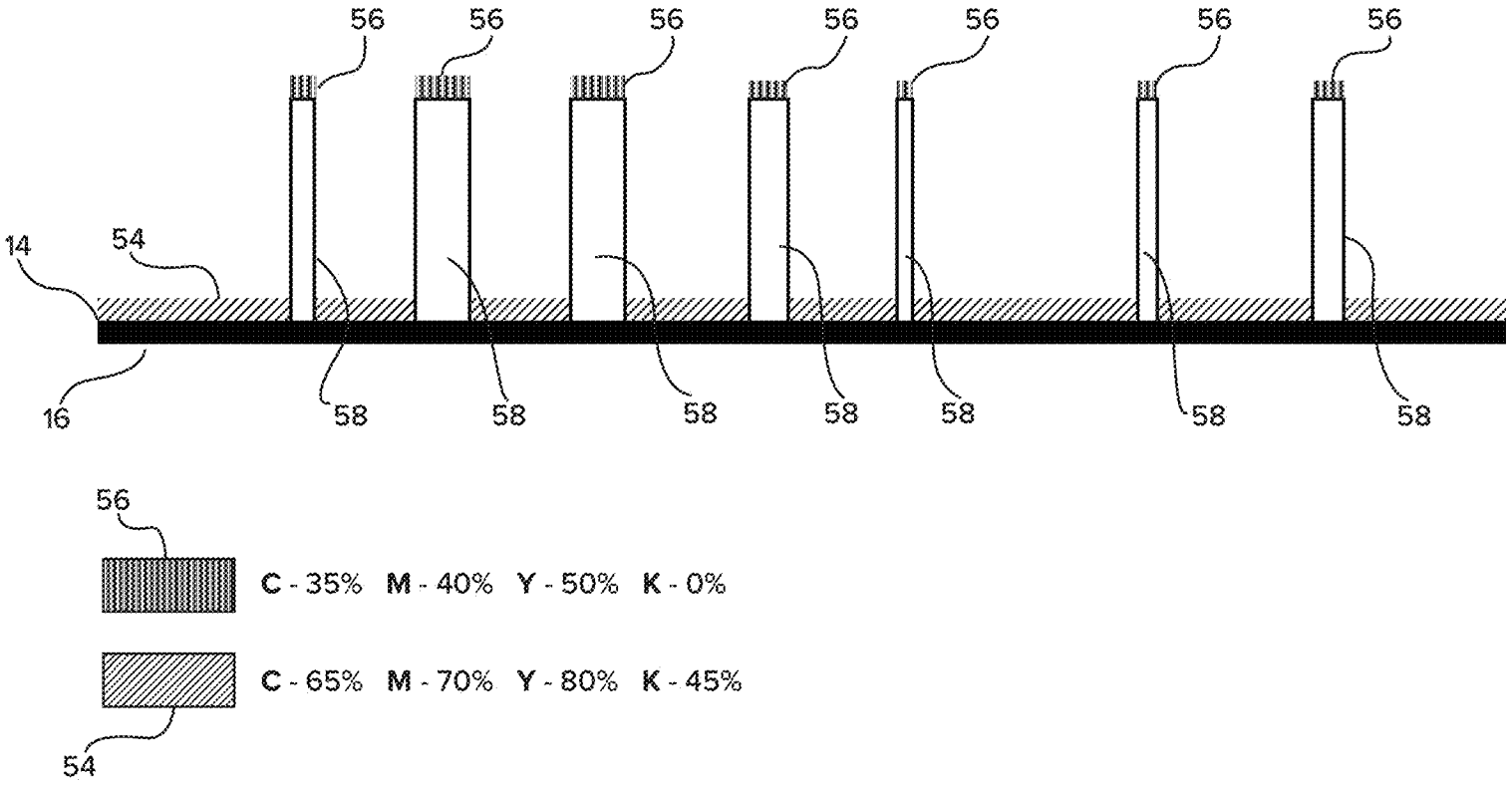
FIG. 6 is a graphic cross sectional depiction through the frame illustrating areas formed of one or more layers of dark brown ink and areas formed of at least two layers of white ink overlaid with light brown ink.

Imprinted upon the obverse face 14 of the framed poster 10 are discrete areas formed of one or more layers of dark brown ink 54 and discrete areas formed of layers of white ink 58. The layers of white ink 58 are overlaid with one or more layers of light brown ink 56 as illustrated in FIG. 6. The multiple layers of white ink 58 serve to distance the UV cured surface of the light brown ink 56 from the UV cured surface of the dark brown ink 54.

The distance between the respective UV cured surfaces not only augments the three dimensional visual effect of the relief printing but are sufficient to be discernable by touch.

Thus it will be seen that there is provided a framed metal poster which achieves the various aspects, features and considerations of the present invention and is well suited to meet the conditions of practical use.

It should be noted that although multiple layers of white ink have been disclosed, employment of a single layer with increased saturation is also within the ambit of the invention as well as the employment of layers of white ink 58 which are not covered. Additionally, layers of UV curable ink which project a distance greater than 032 mm should be considered to be encompassed within the invention. Further, while in the exemplary embodiment a wood grain relief printed pattern has been depicted, any number of patterns may be employed, other than wood.

The particular combinations of elements and features in the above-detailed embodiment are exemplary only; the interchanging and substitution of these teachings with other teachings in this application are also expressly contemplated. As those skilled in the art will recognize, variations, modifications, and other implementations of what is described herein can occur to those of ordinary skill in the art without departing from the spirit and the scope of the invention as claimed.

Further, in describing the invention and in illustrating embodiments of the invention in the figures, specific terminology, numbers, dimensions, materials, etc., are used for the sake of clarity. However the invention is not limited to the specific terms, numbers, dimensions, materials, etc, so selected, and each specific term, number, dimension, material, etc., at least includes all technical and functional equivalents that operate in a similar manner to accomplish similar purpose. Use of a given word, phrase, number, dimension, material, language terminology, product brand, etc. is intended to include all grammatical, literal, scientific, technical, and functional equivalents.

Having described the preferred embodiments of the invention, it will now become apparent to one of ordinary skill in the art that other embodiments incorporating the concept may be used. Moreover, those of ordinary skill in the art will appreciate that the embodiment of the invention described herein can be modified to accommodate and/or comply with changes and improvements in the applicable technology and standards referred to herein.

Having thus described the invention, there is claimed and new and desired to be secured by Letters Patent:

1. A metal poster comprising a rectangular sheet metal plate having an obverse face, a rear face and a peripheral selvage, image indicia imprinted on the obverse face, the image indicia being surrounded by a relief printed frame imprinted on the obverse face in the configuration of frame indicia which differs from the image indicia, the frame indicia comprising a plurality of layers of UV curable ink, the relief printed frame having proximal edges separating the image indicia from the frame indicia, the relief printed frame having a fold line spaced outwardly from each proximal edge, the relief printed frame being bent along each fold line such that portions of the relief printed frame between the proximal edges and the fold lines appear on the obverse face and portions of the relief printed frame extending beyond the fold lines overly the rear face, whereby the frame indicia appears along the edges of the fold lines when the sheet metal poster is viewed edgewise.

2. The metal poster in accordance with claim 1 wherein the edges of the fold lines are rounded.

3. The metal poster in accordance with claim 1 wherein selected areas of the relief printed frame project from the obverse face a distance greater than other areas of the frame.

4. The metal poster in accordance with claim 3 wherein the plurality of layers project from the obverse face a maximum distance of 0.32 mm.

5. The metal poster in accordance with claim 4 wherein the selected areas project from the obverse face a distance between 0.00 mm, and 0.32 mm.

6. The metal poster in accordance with claim 1 wherein the plurality of layers include layers having a white color.

7. The metal poster in accordance with claim 6 wherein at least one layer of UV curable ink having a color other than white overlays the layers having a white color.

8. The metal poster in accordance with claim 1 wherein layers of differently colored UV curable ink are imprinted at different locations on the relief printed frame.

9. A sheet metal plate having an obverse face, a rear face, four corners and a selvage, image indicia imprinted on the obverse face, the image indicia being surrounded by a frame imprinted on the obverse face, the frame being relief printed of layers of UV curable ink in the configuration of frame indicia which differs from the image indicia, the frame including fold lines positioned on the frame between the image indicia and the selvage, the fold lines intersecting one another, the frame extending beyond the fold lines, the frame including 45° angle cut lines at the intersections of the fold lines, the sheet metal plate being foldable at the fold lines to provide the frame with rounded edges, with portions of the frame between the image indicia and the fold lines appearing of the obverse face and portions of the frame between the fold lines and the selvage overlying the rear face, whereby the frame indicia appears on the rounded edges.

10. A method of fabricating a sheet metal poster comprising the steps of:

a) providing the sheet metal plate in accordance with claim 9, the sheet metal plate being rectangular,
b) removing triangular portions at each of the corners by cutting each corner at each cut line, and
c) providing the frame with rounded edges by folding the selvage portions having the relief printed frame at the fold lines and over the rear face.

11. A method of fabricating a sheet metal poster comprising the steps of:

a) providing the sheet metal plate in accordance with claim 9;
b) positioning the sheet metal plate at a first finishing station,
c) cutting the four corners at the 45° angle cut lines at the first finishing station,
d) positioning the sheet metal plate at a second finishing station,
e) folding the selvage portions adjacent either the longitudinal fold lines or the transverse fold lines against the rear face at the second finishing station,
f) positioning the sheet metal plate at a third finishing station,
g) rotating the sheet metal plate 90° at the third finishing station,
h) positioning the sheet metal plate at a fourth finishing station, and
i) folding the selvage portions which were not folded in step e) against the rear face at the fourth finishing station.

12. A unitary metal poster comprising a sheet metal plate having an obverse face and a rear face, image indicia imprinted on the obverse face, the image indicia being surrounded by a frame imprinted on the obverse face in the configuration of frame indicia which differs from the image indicia, selected areas of the frame comprising a plurality of layers of colored ink projecting from the obverse face a distance greater than other areas of the frame, the frame having proximal edges separating the image indicia from the frame indicia, the frame having a single fold line spaced outwardly from each proximal edge, the frame being bent along each fold line, portions of the frame indicia being visible at the fold lines when the frame is bent along the fold lines, portions of the frame which extend beyond the fold lines overlying the rear face.

13. The metal poster in accordance with claim 12 wherein the frame is rounded at each fold line.

14. The metal poster in accordance with claim 12 wherein the plurality of layers includes layers having a white color.

15. The metal poster in accordance with claim 14 wherein at least one layer of ink having a color other than white overlays the layers having a white color.

16. The metal poster in accordance with claim 12 wherein the selected areas extend from the obverse face a distance between 0.00 mm, and 0.32 mm.

17. The metal poster in accordance with claim 12 wherein the colored ink comprises ink having the CMYK color model.

18. The metal poster in accordance with claim 12 wherein the colored ink comprises UV curable ink.

* * * * *